United States Patent [19]

Valka

[11] 4,300,637

[45] Nov. 17, 1981

[54] TOOL FOR REMOTELY DETERMINING THE POSITION OF A DEVICE IN AN UNDERWATER WELL ASSEMBLY

[75] Inventor: William A. Valka, Spring, Tex.

[73] Assignee: Armco Inc., Middletown, Ohio

[21] Appl. No.: 120,696

[22] Filed: Feb. 11, 1980

[51] Int. Cl.[3] ..... E21B 7/12

[52] U.S. Cl. ..... 166/336; 166/341; 285/93

[58] Field of Search ..... 166/336, 332, 339, 340–345, 166/348, 349, 351, 360, 359; 285/93

[56] References Cited

U.S. PATENT DOCUMENTS

| | | | |
|---|---|---|---|
| 3,321,217 | 5/1967 | Ahlstore | 285/18 |
| 3,534,984 | 10/1970 | Shuey | 285/93 X |
| 3,551,065 | 12/1970 | Brun | 166/341 |
| 4,171,922 | 10/1979 | Coulboy et al. | 166/341 |

*Primary Examiner*—William F. Pate, III

*Attorney, Agent, or Firm*—Roylance, Abrams, Berdo & Farley

[57] ABSTRACT

Tool for giving remote indications, typically both a change in fluid pressure and a televised image, to check whether a device is in a desired position. The invention is particularly useful for checking whether a component, such as a pipe hanger, has been properly landed in an underwater well installation.

10 Claims, 4 Drawing Figures

TOOL FOR REMOTELY DETERMINING THE POSITION OF A DEVICE IN AN UNDERWATER WELL ASSEMBLY

This invention relates to tools for determining by remote operation whether or not a device, typically a rotationally oriented multiple string tubing hanger, occupies a specific intended position in an underwater well assembly.

RELATED APPLICATIONS

Tools according to the invention are especially useful for checking the orientation of multiple string tubing hangers of the type disclosed and claimed in U.S. patent applications Ser. Nos. 120851 and 120695 filed concurrently herewith by John E. Lawson.

BACKGROUND OF THE INVENTION

In completing underwater oil and gas wells of the type in which multiple strings of tubing are suspended from a single tubing hanger, it is necessary to orient the tubing hanger to a known rotational position, then land the hanger while preserving its specific rotational orientation since, if the multiple string tubing hanger does not occupy a known rotational position, it becomes impossible to mate the multiple flow passages of later-installed components, such as the production upper body, with the respective flow passages of the tubing hanger. Much work has been done in the prior art to provide for orientation of the tubing hanger or like component, as seen for example in copending application Ser. No. 36,659, filed May 7, 1979, by Michael L. Wilson. However, the uncertainties involved in remote installation of well systems, particularly in deep water, are such that it has been found desirable to check the position of the landed tubing hanger, or other components, to make certain that the position is precisely the position intended. Such a check must be accomplished remotely, by operations carried out at the surface of the body of water, and no completely satisfactory tool for this purpose has heretofore been provided.

OBJECTS OF THE INVENTION

A primary object is to devise a tool which can be manipulated with a handling string to determine with accuracy whether a component, such as a multiple string tubing hanger which has been oriented and then landed in an underwater well assembly, in fact occupies the intended position.

Another object is to provide such a tool which provides two separate remotely observable indications of whether the component occupies the desired position.

A further object is to provide a tool of the type described capable of providing, as an indication, a very marked change in hydraulic pressure.

SUMMARY OF THE INVENTION

Tools according to the invention comprise a support connectable to a handling string; guide means connected to the support for cooperating with guidance means to guide the support to the well assembly and to maintain the support in a specific position relative to the well assembly as the support approaches the well assembly; locator means carried by the support and constructed and arranged to coact with a part of the underwater well assembly in a specific fashion only when the support and the well assembly are in one predetermined positional relationship; feeler means mounted on the support for movement from a normal or inactive position to an indicating position, the feeler means being biased to its normal position and occupying a position on the support relative to the locator means such that the feeler means engages the well assembly to be checked and is positively moved to its indicating position only when the component in the well assembly occupies its specific intended position and the locator means coacts with said part of the well assembly; an indicator valve unit mounted on the support and including an internal chamber having an inlet port connectable to means for supplying pressure fluid to the chamber from the operational base, an outlet from which the pressure fluid can escape from the chamber, a valve seat and a movable valve member arranged to coact to close the outlet; the indicator valve unit being disposed for actuation by the feeler means to cause a remotely observable change in pressure in the internal chamber; and second means carried by the support and coacting with the feeler means to provide a second remotely observable indication when the feeler means has actuated the valve unit.

IDENTIFICATION OF THE DRAWINGS

In order that the manner in which the foregoing and other objects are achieved according to the invention can be understood in detail, one particularly advantageous embodiment thereof will be described with reference to the accompanying drawings, which form part of the original disclosure of this application, and wherein.

DETAILED DESCRIPTION OF THE INVENTION

Figure 1:
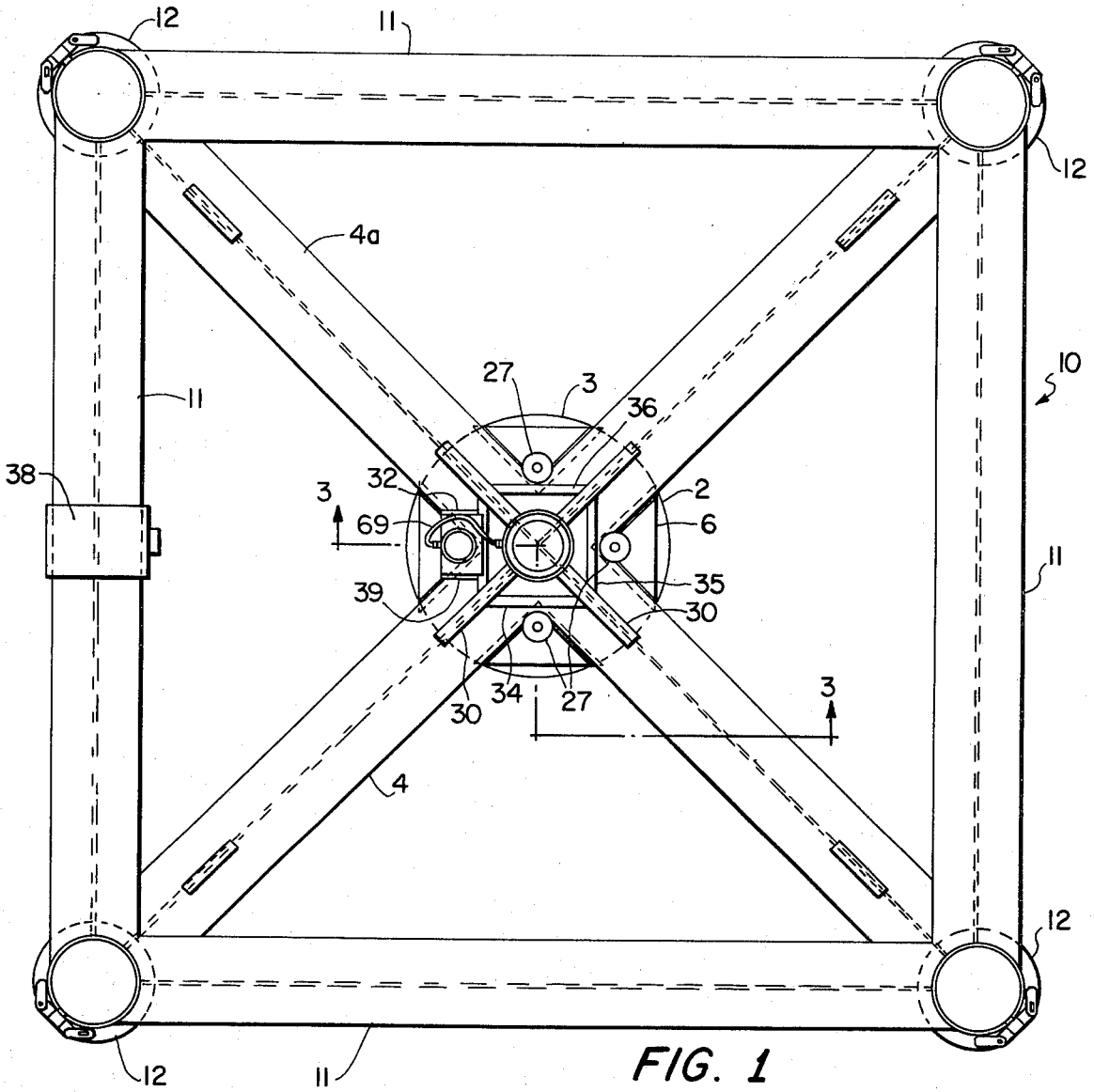
FIGS. 1 and 2 are top plan and side elevational views, respectively, of the tool.
Figure 2:
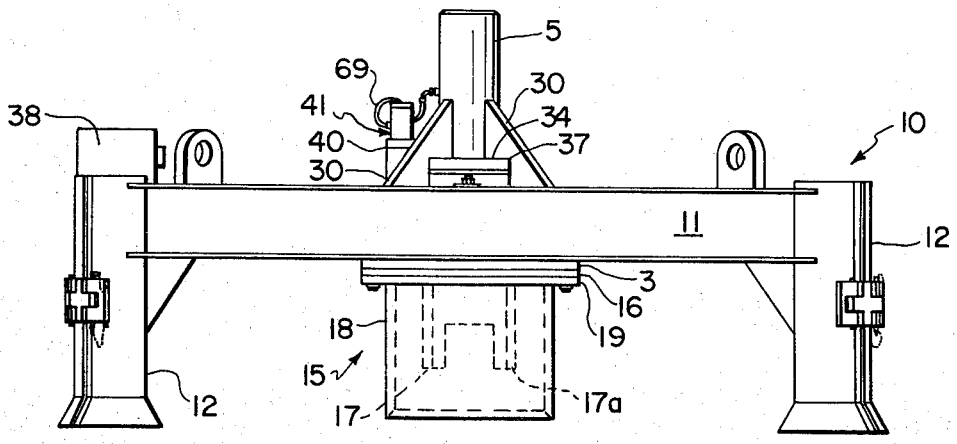

The embodiment of the invention illustrated comprises a support 1 comprising an upper member 2, a lower member 3 and two guide arms 4 and 4*a*. Upper member 2 comprises an upstanding cylindrical hub 5 and, at the bottom of the hub, a flat transverse flange 6 secured rigidly to the hub. The upper end of the hub has a threaded socket 7, to be connected to a handling string (not shown) which opens downwardly into a blind bore 8 which communicates on the one hand with a radial outlet bore 9 and, on the other hand, with the interior of the handling string pipe when the hub is connected to the handling string. Lower member 3 is in the form of a flat plate of circular plan shape.

Guide arms 4 and 4*a* form part of a guide frame indicated generally at 10 and comprising four side members 11 arranged to define a square, a guide tube 12 being secured at each corner of the square and the guide arms 4, 4*a* extending along the respective diagonals of the square. Arm 4 extends continuously from corner to corner of the frame, while arm 4*a* is in two halves, one extending from one corner of the square to the center of arm 4, the other extending from the opposite corner to the center of arm 4. All joints between arms 4, 4*a*, side members 11 and guide tubes 12 are welded to provide the rigid frame. Arms 4, 4*a* are of I-beam configuration.

Flange 6 of upper member 2 is made up of four triangular pieces welded to the upper flanges or arms 4, 4*a* at the center of the frame, and lower member 3 is welded to the lower flanges of arms 4, 4*a* at the center of the frame. Thus, the guide arms effectively extend through the space between flange 6 and member 2.

A locator member 15, comprising a flat circular plate 16 of the same size as lower member 3 and two locator splines 17 and 17*a* depending from and secured rigidly to plate 16, is employed in conjunction with a locator sleeve or skirt 18 having at its upper end a transverse annular outwardly and inwardly projecting flange 19, the inner diameter of flange 19 being such that the flange snugly embraces splines 17, 17*a*. Bolts, as at 20, extend through aligned holes in flange 19, plate 16 and member 3, as shown, to secure those members rigidly together with locator member 15 centered on the central axis of hub 5. Splines 17, 17*a* are of arcuate transverse cross section and are dimensioned to extend downwardly through the respective ones of two gaps of a flange 21 at the upper end of the body of a multiple string tubing hanger 22 supported in the bore of a wellhead lower body 23, the tubing hanger being described in detail in copending application Ser. No. 120695 filed concurrently herewith by John E. Lawson. As fully explained in that application, the two flange gaps are opposed across the hanger body and are of different arcuate width. Accordingly, spline 17 is made with a width such as to be snugly accommodated by one of the gaps, and flange 17*a* has a width such as to be snugly accommodated by the other gap. Hence, splines 17, 17*a* cannot be inserted through the gapped flange 21 of hanger 22 except when locator member 15 is so aligned and oriented relative to the tubing hanger that each spline 17, 17*a* is centered on its respective gap. Sleeve 18 of member 15 has a right cylindrical inner surface dimensioned to slidably embrace the upper end portion of wellhead lower body 23.

Figure 3:
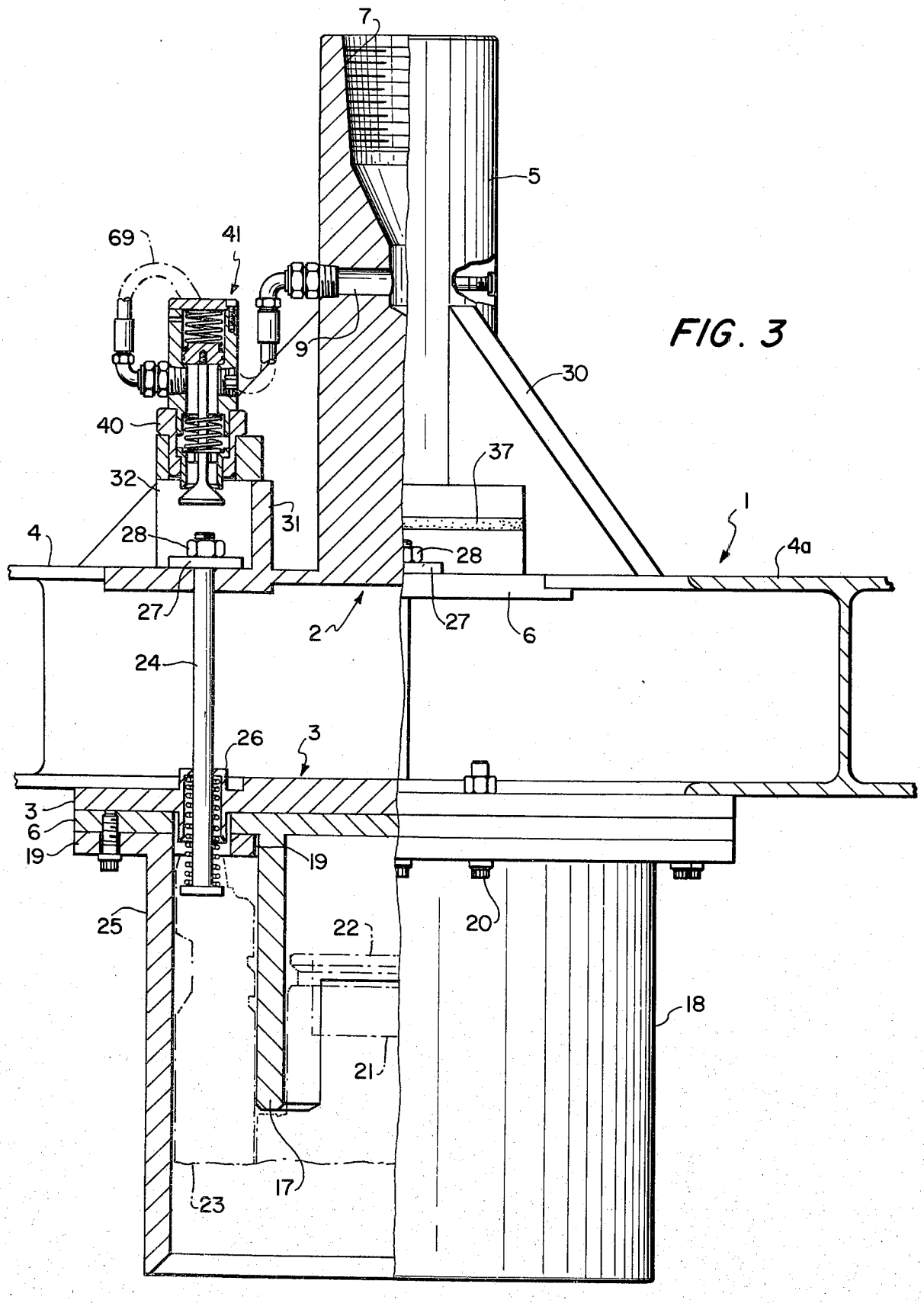
FIG. 3 is a view partly in vertical cross section and partly in side elevation taken generally on line 3—3, FIG. 1, and showing the tool landed on an underwater well assembly and engaged with a multiple string tubing hanger forming part of that assembly.

In locations spaced outwardly from hub 5 and adjacent to the web of one of the guide arms, four sets of vertically aligned openings are provided in flange 19, plate 16, member 3 and flange 6, as seen in FIG. 3. Each such set of opening accommodates a feeler rod, all four feeler rods being identical and one being shown in detail at 24, FIG. 3. At its lower end, the rod has a flat head 25 disposed for flush engagement with the upper end face of wellhead body member 23. Save for its upper tip, which has a threaded portion of smaller diameter, rod 24 is of constant diameter throughout its length and is slidably engaged by the walls of the opening in flange 6 and by an opening in the top wall of a cup-shaped spring retainer 26 carried by member 3, so the rod is retained in an upright position but free to move upwardly or downwardly. The upper end of rod 24 carries a washer 27 secured between a nut 28 and the shoulder at the lower end of the smaller diameter threaded tip portion. A compression spring 29 is housed in retainer 26 and engaged between the top wall of the retainer and head 25, so as to bias rod 24 downwardly. The length of the rod between head 25 and washer 27 is predetermined and is significantly greater than the space between the lower end of retainer 26 and the upper surface of flange 6. As will be clear by comparing FIGS. 1 and 3, all of the feeler rods 24 are aligned above the annular space between the inner surface of skirt 18 and a cylindrical surface containing the arcuate outer faces of splines 17, 17*a*.

Hub 5 and respective guide arms 4, 4*a* are interconnected by four triangular brace plates 30 each centered on one of guide arms 4, 4*a*. A shroud is provided for the rod 24 shown in detail in FIG. 3 and comprises a flat background plate 31 and two flat side plates 32, 33 rigidly secured to flange 6 and extending upwardly therefrom. Background plate 31 has its ends welded to two of the brace plates 30 while side plates 32, 33 project outwardly from the background plate and at right angles thereto to define a window through which the background plate can be viewed. Background plates 34–36 are provided, similarly to plate 31, in each of the remaining spaces between adjacent pairs of brace plates 30, as will be clear from FIG. 1. The outwardly exposed face of each background plate 31 and 34–36 is provided with a visible reference line, as at 37, FIG. 3, all of the reference lines lying in a common plane parallel to flange 6 and spaced thereabove by a distance equal to the space between indicator washer 27 and the upper face of flange 6 when the tool is seated on the wellhead assembly with rod heads 25 engaging the upper end of body 23. Thus, when tubing hanger 22 is properly landed and oriented, and when rods 24 are in their raised indicating positions, a television camera 38 will observe washer 27 aligned with reference line 37 on plate 31, the principal axis of the lens being directed to line 37 through the position occupied by washer 27 when the feeler rod is in its indicating position.

Figure 4:
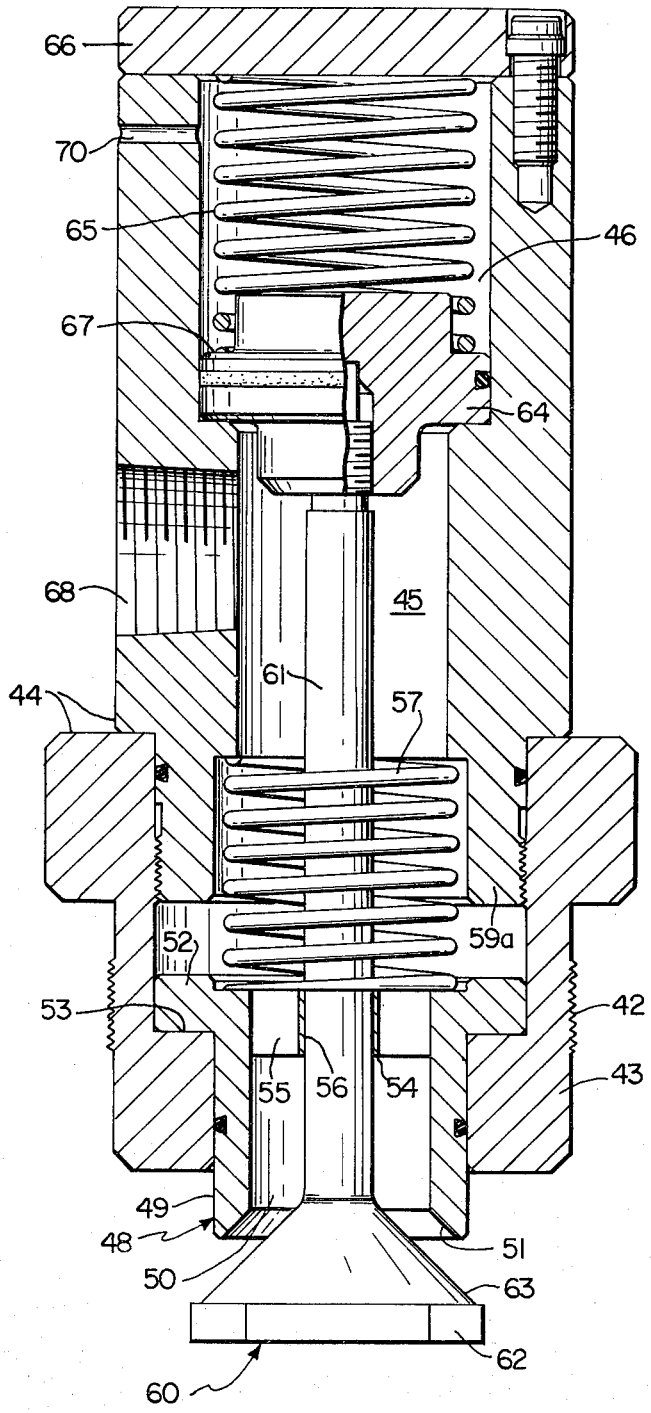
FIG. 4 is a vertical cross sectional view of a valve unit forming part of the tool of FIGS. 1–3.

Secured to the upper edges of shroud walls 31–33 is a mounting bar 40 having a threaded through bore aligned coaxially with feeler rod 24. An indicator valve unit, indicated generally at 41 in FIG. 3 and shown in detail in FIG. 4, is secured in the through bore of mounting bar 40, as by external threads 42 on lower member 43 of an upright valve body 44. Body 44 is completed by an upper body member 59 and defines a cylindrical internal chamber 45, a cylinder 46 of larger diameter than chamber 45 and located thereabove, and a guide bore 47 located below chamber 45 and of smaller diameter. Chamber 45, cylinder 46 and bore 47 are coaxial. A valve seat member 48 has its right cylindrical outer surface 49 slidably embraced by the wall of bore 47. Member 48 is tubular for most of its length, so as to define an outlet passage 50 terminating in an upwardly and inwardly tapering transverse annular valve seat 51. The upper end of member 48 is outwardly enlarged to provide an outer flange 52 capable of downward engagement with a shoulder 53 provided by body member 43. Also at its upper end, member 48 has a partition 54 with through passages 55 for fluid flow and a central through bore 56. A compression spring 57 is engaged between the upper end of member 18 and a downwardly facing transverse annular shoulder 58 in upper body member 59.

A movable valve member 60 has an elongated spindle 61 and a head portion 62 presenting an upwardly directed frustoconical face 63 dimensioned to mate with valve seat 51. Spindle 61 extends upwardly through bore 56, being slidable with respect thereto, and completely through chamber 45 to terminate in a threaded upper tip engaged in a threaded blind bore in piston 64. Piston 64 has a diameter such as to be slidably embraced by the wall of cylinder 46. Cylinder 46 opens upwardly and is closed by end wall member 66, as shown, a compression spring 65 being engaged between member 66 and an upwardly directed shoulder 67 on the piston. A radial inlet bore 68 extends through the side wall of chamber 45 and is threaded to accept a connector at one end of an external conduit 69, FIG. 1, the other end of conduit 69 being connected to bore 9 of hub 5, placing internal chamber 45 of the valve unit in communication with bore 8 of hub 5 and thus, via the bore of the handling string, with a source of fluid under pressure on the operational base at the surface of the body of water. An outlet or vent 70 is provided for cylinder 46, as shown.

Body members 43, 59 are generally tubular and secured rigidly together, as by a threaded joint between a dependent portion 59*a* of member 59 and the upper end portion of member 43, as shown. A fluid-tight seal is provided, as by an O-ring, between portion 59*a* and member 43. Sliding fluid-tight seals are provided between valve seat member 48 and surface 47 of member 43, and between piston 64 and the surrounding cylinder wall, as shown. The guide bore 47 has a diameter significantly smaller than that of the wall of cylinder 46 so that, when the valve is closed, with line pressure still applied via inlet 68 to chamber 45, the pressure in chamber 45 acts against a larger effective area of the piston and a smaller effective area of the valve seat member and the combination of the piston, movable valve member and valve seat member is therefore moved upwardly, as a result of the difference in effective areas, until the valve seat member engages the lower end of body portion 59*a*.

Valve member 60 is normally in its lower, open position as seen in FIG. 4 so that pressure fluid supplied to chamber 45 at a constant pressure escapes via passages 55 and outlet 50. The greater effective area of piston 64 is not adequate, in view of the strength of springs 57 and 65, to provide a fluid pressure-generated force adequate to move valve member 60 upwardly. Hence, the valve remains open and fluid pressure observed by a gauge (not shown) at the source on the operational base remains steady. When rod 24 is forced upwardly to its indicating position, as a result of engagement with body 23, valve member 60 is moved upwardly to engage surface 63 with seat 51 and force valve seat member 48 slightly upwardly in guide bore 47. With the valve thus closed, and pressure fluid still supplied to chamber 45, the greater effective area of piston 64, as compared to that of a valve seat member 48, provides net force acting on the piston in excess of the spring force, so that the piston, movable valve member and valve seat member move upwardly until the valve seat member engages body portion 59*a* as a stop. Since fluid can no longer escape and the movable elements are stopped, an abrupt increase in pressure is observed at the operational base, signalling that the tubing hanger is properly landed in its oriented position.

It will be understood that seat 51 and surface 63 are machined to coact in metal-to-metal seal fashion, so that the mechanical action resulting from engagement of valve head 62 with feeler rod 24 is adequate for closing the valve. The increased pressure between surface 63 and seat 51 which results from continued upward movement of the piston, movable valve member and valve seat member against the biasing force of the springs adds to positiveness of closing of the valve but has the greater advantage that, since valve head 62 retreats upwardly from feeler rod 24 after the valve has been closed, there is no need for the high degree of dimensional accuracy which would be required if, once the valve closed, head 62 rigidly opposed the feeler rod.

From FIG. 4, it will be seen that, when the valve is closed, head 62 of the movable valve member is located wholly outside of the valve body. Once the valve has been actuated to close, as a result of engagement of head 62 with the upper end of feeler rod 24, the action of the valve causes head 62 of movable valve member 60 to move upwardly, away from the end of rod 24, so that indicator washer 27 is more clearly distinguishable against background plate 31.

What is claimed is:

1. In a tool for determining by operations carried out from an operational base at the surface of a body of water whether, in an underwater well assembly equipped with guidance means, a device in the well assembly occupies a specific intended position, the combination of support means connectable to a handling string;

guide means connected to the support and constructed and arranged to coact with the guidance means to maintain the support in a specific position relative to the underwater well assembly as the support approaches the well assembly;

locator means carried by the support and constructed and arranged to coact with a part of the underwater well assembly in a specific fashion only when the support and said part of the well assembly are in one predetermined positional relationship;

feeler means mounted on the support for movement from a normal position to an indicating position, the feeler means being biased to its normal position and occupying a position on the support relative to the locator means such that the feeler means engages a part of the well assembly and is thereby positively moved to its indicating position only when the device in the wellhead occupies its specific intended position and the locator means coacts with said part of the well assembly;

an indicator valve unit mounted on the support and comprising a body defining an internal chamber and having an inlet port connectable to means for supplying pressure fluid to the chamber from the operational base, and an outflow port via which pressure fluid can escape from the chamber, a valve seat, and a movable valve member mounted to coact with the valve seat and biased to a first position relative to the valve seat;

the valve seat and movable valve member being disposed to control fluid flow via the outflow port;

the indicator valve occupying a position on the support such that the movable valve member is engaged by the feeler means and moved to a second position relative to the valve seat when the feeler means moves to its indicating position, movement of the movable valve member to its second position causing a pressure change in the internal chamber, which change can be observed remotely as a first indication that the device in the well assembly occupies its specific intended position; and second means carried by the support and coacting with the feeler means to provide a second remotely observable indication that the device in the well assembly occupies its specific intended position.

2. The combination defined in claim 1, wherein the locator means comprises at least one downwardly directed spline dimensioned to be inserted downwardly through a gap presented by the device in the well assembly.

3. The combination defined in claim 2, wherein
the locator means further comprises
a second downwardly directed spline dimensioned to be inserted downwardly through a second gap presented by the device in the well assembly,
the two splines having different dimensions such that each spline can be inserted only through a corresponding one of the gaps.

4. The combination defined in claim 1, wherein
the support includes an upwardly extending member;
the feeler means comprises an upright feeler rod mounted for vertical movement beside the upwardly extending member of the support,
the feeler rod being movable from its normal position upwardly to first engage the movable valve member, then actuate the valve member upwardly, and arrive at said indicating position,
the relative positions of the feeler rod and the upwardly extending member of the support being such that when the feeler rod occupies said indicating position the upper end of the rod can be viewed against a lateral surface of the upwardly extending member as a background; and
the second means coacting with the feeler means to provide a second remotely observable indication comprises
an observable reference mark on the lateral surface of the upwardly extending member of the support, and
a television camera carried by the support in a position such that the principal axis of the lens of the camera extends through both the upper end of the feeler rod and the reference mark only when the feeler rod occupies its indicating position.

5. The combination defined in claim 4, wherein
the support comprises
a centrally located upwardly projecting hub for attachment to a handling string and having a laterally projecting transverse flange spaced below the upper end of the hub,
a plurality of guide arms, the annular flange of the hub being secured to the guide arms, and
a lower member secured to the guide arms below the flange of the hub, the locator means being rigidly carried by the lower member and depending therefrom,
the flange and said lower member having vertically aligned apertures and the feeler rod extending through the apertures.

6. The combination defined in claim 5, wherein
said lower member of the support is flat and the support further comprises
a tubular skirt secured to and depending from the lower member to embrace a part in the well assembly;
the locator means comprising at least one spline depending from the lower member and spaced inwardly from the skirt,
the vertical axis of the feeler rod extending through the space between the inner surface of the skirt and the outer face of the spline.

7. The combination defined in claim 6, wherein
the guide arms of the support constitute portions of a rectangular frame comprising four side members, there being two guide arms each extending along a different diagonal of the rectangle of the frame and secured at its outer ends to the respective side members,
the guide arms extending through the space between the flange of the hub and the flat lower member.

8. The combination defined in claim 1, wherein
the support comprises
an upwardly projecting hub to be connected to a handling string, and
a generally flat upper surface extending transversely of the hub below the upper end thereof,
the feeler means comprises
an upright feeler rod extending through an aperture in said flat upper surface,
the upper end of the feeler rod being spaced above said flat surface when the feeler rod is in said indicating position;
the combination further comprising
shroud means comprising upright wall means secured to the support and projecting upwardly therefrom to partially surround the feeler rod when the rod is in said indicating position,
said wall means defining a window opening away from the hub and through which the feeler rod is outwardly exposed,
a portion of said wall means being disposed between the feeler rod and the hub;
the indicator valve unit being mounted on said shroud means with the movable valve member being centered above the feeler rod.

9. The combination defined in claim 8, wherein
the second means coacting with the feeler means to provide a second remotely observable indication comprises
an observable reference mark on said portion of the wall means, the reference mark being carried by that surface of said portion of the wall means which is exposed for view through the window, and
a television camera carried by the support in a position such that the principal axis of the lens of the camera extends through both the upper end portion of the feeler rod and the reference mark only when the feeler rod occupies its indicating position.

10. The combination defined in claim 1, wherein
the feeler means is a feeler rod;
the body of the indicator valve unit has
a valve seat guide bore located at one end and a cylinder located at the other end,
the internal chamber, guide bore and cylinder being coaxial and the internal chamber being located between the guide bore and cylinder;
the valve seat being an outer surface of a valve seat member slidably disposed in the guide bore;
the movable valve member comprises
an elongated stem,
a valve head fixed to one end of the stem, and
a piston fixed to the other end of the stem,
the piston being operatively disposed in the cylinder,
the stem projecting through the internal chamber and the valve seat member,
the valve head being located beyond the valve seat member, having a valve surface directed toward the seat member to cooperate with the valve seat, and being disposed for endwise engagement by the feeler rod;

the indicator valve unit further comprises stop means coacting with the piston and the valve seat member to limit outward movement thereof to predetermined positions in which the valve head is spaced outwardly from the valve seat, and spring means biasing the piston and valve seat member to cause the stop means to so coact, and means responsive to fluid pressure in the internal chamber, when the valve is closed, operative to cause the movable valve member and the valve seat member to retreat from the feeler rod after engagement of the valve head with the feeler rod has closed the valve.

* * * * *